US012268260B1

(12) United States Patent
Lian

(10) Patent No.: US 12,268,260 B1
(45) Date of Patent: Apr. 8, 2025

(54) HAIR WEFT AND PREPARATION PROCESS THEREOF

(71) Applicant: WELLNA CO., LTD, Kl (HK)

(72) Inventor: Xiangpeng Lian, Rongcheng (CN)

(73) Assignee: WELLNA CO., LTD, Kl (HK)

( * ) Notice: Subject to any disclaimer, the term of this patent is extended or adjusted under 35 U.S.C. 154(b) by 0 days.

(21) Appl. No.: 18/815,791

(22) Filed: Aug. 26, 2024

Related U.S. Application Data

(63) Continuation-in-part of application No. 18/410,869, filed on Jan. 11, 2024.

(51) Int. Cl.
*A41G 5/00* (2006.01)

(52) U.S. Cl.
CPC ..... *A41G 5/0046* (2013.01); *A41G 5/0073* (2013.01); *A41G 5/008* (2013.01)

(58) Field of Classification Search
CPC ..... A41G 5/00; A41G 5/004; A41G 5/0053; A41G 5/0073; A41G 5/008; A41G 5/0046
See application file for complete search history.

(56) References Cited

U.S. PATENT DOCUMENTS

2023/0109742 A1* 4/2023 Gray ..... A41G 5/0046 132/201
2024/0225163 A1* 7/2024 Chen ..... A41G 5/008

* cited by examiner

*Primary Examiner* — Rachel R Steitz
(74) *Attorney, Agent, or Firm* — Ying-Ting Chen

(57) ABSTRACT

A hair weft includes a first hair weft unit and a second weft unit, the first hair weft unit includes a first hair strand a hair transplantation base, wherein the first hair strand is fixed to the hair transplantation base, the second weft unit includes a second hair strand and an attaching base, wherein the second hair strand is fixed to the attaching base, wherein the attaching base is attached to the hair transplantation base.

16 Claims, 21 Drawing Sheets

A

B

C

D

E

HAIR WEFT AND PREPARATION PROCESS THEREOF

CROSS REFERENCE

This is a Continuation-In-Part application that claims the benefit of priority under 35U.S.C. § 120 to a non-provisional application, application Ser. No. 18/410,869, filed date Jan. 11, 2024, which is a non-provisional application that claims the benefit of foreign priority to Chinese Patent Application No. 202311804410.7, filed date Dec. 25, 2023, the entire contents of which are hereby incorporated by reference in their entirety.

TECHNICAL FIELD

The present disclosure relates to the technical field of hairdressing supplies manufacturing, specifically to hair weft.

BACKGROUND

The importance that people place on their appearance is increasing, and more and more people want to be able to change their image by changing their hairstyle. However, due to the limitations of factors such as the growth cycle and quality of hair, many people are unable to fulfill their personal hairstyle needs. In this case, hair extensions become people's first choice. As the most traditional product type in the hair product industry, hair weft has a place in the market for its wide coverage area on the head and large volume of hair.

Currently on the market, the hair weft is mostly handmade or machine-made, but the hair wefts prepared by the two production methods have obvious weft edge, which has a large thickness affecting the wearing comfort, and is not invisible enough causing obvious appearances. Further, both the above two kinds of hair wefts have folded hair, and the folded-back short hair will be in contact with the scalp when the wearer activities, resulting in a tingling sensation.

The CN Patent No. CN108835745A discloses a hair extension piece simulating human hair and a preparation method thereof. The hair extension piece includes a substrate, a hair strand, where an end of the hair strand passes through the substrate and is fixed to a back side of the substrate through an adhesive; the hair strand is flatly affixed to a front side of the substrate and is perpendicular to a length direction of the substrate. The preparation method includes: 1) making/preparing a substrate; 2) preparing a spacer; 3) preparing a hair transplantation marking area/marking paper; 4) binding auxiliary materials; 5) preparing a hair strand for hair transplantation; 6) hair transplantation; 7) cutting; 8) fixing; 9) finished product cutting: the substrate after smearing and baking is cut into the desired shape by using scissors or a knife mold; and the finished hair extension piece is thus made. The advantage is that the front side of the hair extensions made by the CN Patent is not required to be fixed by glue. However, the CN Patent has disclosed the production method of the hair extension pieces but not disclosed the production method of hair wefts, and thus cannot solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation.

SUMMARY OF THE DISCLOSURE

The present disclosure is intended to solve at least one of the technical problems of the prior art. To this end, a first aspect of the present disclosure proposes a hair weft, including:

a first hair weft, including a hair transplantation base and a first hair strand; wherein the hair transplantation base includes a mesh base and a spacer disposed above the mesh base; the spacer is configured to clamp the first hair strand after the first hair strand passes through the mesh base and the spacer; the mesh base is configured to affix the first hair strand to a side of the mesh base after the spacer and the mesh base are separated; and a second hair weft, including a second hair strand; wherein a top of the second hair strand is fixed through a quilting line and a glue; wherein the second hair weft is cut and affixed flush to a bottom of the first hair weft, forming the hair weft.

In some embodiments, a material of the mesh base is a non-stretchy, densely perforated, ultra-thin mesh silk yarn.

In some embodiments, a material of the spacer is PVC artificial leather.

The embodiments of the present disclosure further propose a preparation method of the hair weft, including:

Step 1, preparing the hair transplantation base: cutting the mesh base and the spacer to a predetermined shape, marking a hair transplantation area on the spacer, and aligning the mesh base and the spacer to be bound together;

Step 2, preparing the first hair strand and placing the first hair strand in a predetermined area;

Step 3, preparing the first hair weft: after passing the first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft;

Step 4: preparing the second hair weft: fixing a top of the second hair strand that is organized to a same height through two quilting lines and further fixing with the glue;

Step 5, preparing the hair weft: cutting the first hair weft and the second hair weft, and affixing the second hair weft flush to the bottom of the first hair weft; and Step 6, cleaning treatment: soaking the hair weft in an alkaline solution, and soaking the hair weft in a softener.

In some embodiments, the Step 2 includes:

organizing the first hair strand to a uniform height;

fixing a middle part of the first hair strand;

placing the first hair strand in a transplantation area of a transplantation machine; and placing the mesh base and the spacer in turn above the transplantation area.

In some embodiments, the Step 3 includes:

utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area;

cutting the first hair strand located between the spacer and the mesh base, affixing the first hair strand to the mesh base through an adhesive, and drying; and cutting the first hair strand on the side of the mesh base away from the spacer to 0.1 to 2 cm, to obtain the first hair weft.

In some embodiments, the Step 4 includes:

organizing the second hair strand to a uniform height;

forming the two quilting lines on the top of the second hair strand through a double-needle sewing machine;

applying a tape 1.2 to 1.5 inches from the top of the second hair strand; and applying a prepared glue to evenly coat the tape to the top of the second hair strand, and drying.

In some embodiments, the Step 6 includes:

putting 100 g of the hair weft into 1 kg of 40° C. water, adding 2 g to 3 g of sodium hypochlorite solution, and soaking for 5 minutes;

cleaning the hair weft for three times using 40° C. water;

after the cleaning, putting the hair weft into 1 kg of 50° C. water, adding 30 g of softener, and soaking for 10 minutes; and after the cleaning, putting the hair weft into 1 kg of 50° C. water, adding 40 g of softener, and soaking for 10 minutes.

The embodiments of the present disclosure provide a hair weft and a preparation process thereof, which have the following beneficial effects compared with the prior art:

By providing the hair transplantation base, the first hair strand, the first hair weft, the second hair weft, the finished hair weft, and cleaning and processing, a hair weft close to the state of human hair growth is obtained. There is no weft edge in the conventional sense of the traditional hair weft. After wearing, the hair weft blends in with the wearer's own hair, which is more invisible. No hair back occurs, which enhances the wearing experience, solving the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

The present invention is advantageous in that it provides a hair weft and preparing method thereof, wherein the hair weft comprises a first hair weft unit and a second hair weft unit, the first hair weft unit comprises a hair transplantation base and a first hair strand which is transplanted on the hair transplantation base, the second hair weft unit comprises a second hair strand which is attached to the hair transplantation base, so as to increase the hair volume of the hair weft product.

Another advantage of the present invention is to provide a hair weft and preparing method thereof, wherein the first hair weft unit may have a insufficient bristle density and volume which fail to meet the desired standards for a larger hair volume, wherein the second hair weft unit with a higher bristle density and volume is produced and is combined with the first hair weft unit using an adhesive to achieve the required hair volume. Accordingly, combining two hair weft units compensates for the lower volume of the first hair weft unit to result in a final product that meets the volume requirements.

Another advantage of the present invention is to provide a hair weft and preparing method thereof, wherein the hair transplantation base is glued between the two hair strands, so as to ensure a strong bond and help in achieving a seamless integration of the two hair weft units.

Another advantage of the present invention is to provide a hair weft and preparing method thereof, wherein this method allows for flexibility in adjusting the hair volume by changing the density of either the first or the second hair weft unit.

Another advantage of the present invention is to provide a hair weft and preparing method thereof, wherein a top of the first hair strand body is extending from a top edge of the hair transplantation base and naturally draping over it in a curved manner, the second hair strand body is extending from a bottom edge of the hair transplantation base, the starting points of their extensions are different, with the more curled first hair strand overlaying the second hair strand, a layered and three-dimensional effect is created, so that the difference in starting points adds visual depth and texture, mimicking the natural layering of hair.

Another advantage of the present invention is to provide a hair weft and preparing method thereof, wherein the second hair strand has a higher density, providing greater thickness and being positioned closer to the scalp when the hair weft is worn on a head of the user, so that this arrangement simulates the natural decrease in hair density from the scalp toward outward, so as to enhance the sense of layering. In other words, this structure mimics the natural distribution of hair density, which is higher near the scalp and decreases outward, so as to provide a more realistic transition from scalp to ends. The layered structure also allows for versatile styling options, accommodating various looks and preferences.

Another advantage of the present invention is to provide a hair weft and preparing method thereof, wherein both hair weft units are positioned vertically during the assembly process, this ensures that the hair strands align properly and maintain the intended orientation.

According to another aspect, the present invention provides a hair weft, comprising:

a first hair weft unit comprising a first hair strand a hair transplantation base, wherein the first hair strand is fixed to the hair transplantation base; and a second weft unit comprising a second hair strand and an attaching base, wherein the second hair strand is fixed to the attaching base, wherein the attaching base is attached to the hair transplantation base.

According to an embodiment, the first hair strand comprises a first hair strand body and a first root portion integrally extended from the first hair strand body, wherein the first root portion is penetrating through the hair transplantation base and adhered to the hair transplantation base, wherein the first hair strand body and the first root portion are provided at two opposite sides of the hair transplantation base.

According to an embodiment, the hair transplantation base comprises a silk mesh and a glue layer applied on the silk mesh.

According to an embodiment, the second hair strand comprises a second hair strand body and a second root portion integrally extended from the second hair strand body, wherein the second root portion of the second hair strand is fixed to the attaching base.

According to an embodiment, the attaching base of the second weft unit is formed by a glue material, wherein the second root portion of the second weft unit is embedded in the attaching base.

According to an embodiment, the glue material of the attaching base of the second weft unit comprises a mixture of polyurethane glue, adhesive, and thinner.

According to an embodiment, in the glue material of the attaching base of the second weft unit, a weight content of polyurethane glue is ranged from 40%-60%, a weight content of adhesive is ranged from 10%-30%, and a weight content of thinner is ranged from 20%-40%.

According to an embodiment, the attaching base of the second weft unit comprises an attached tape.

According to an embodiment, the first hair strand body of the first hair strand and the second hair strand body of the second hair strand are provided at two opposite sides of the hair transplantation base.

According to an embodiment, a density of the first hair strand is lower than a density of the second hair strand.

According to an embodiment, the first hair strand body of the first hair strand is extended from a front surface of the hair transplantation base, a top end of the second hair strand body of the second hair strand is extended from a bottom edge of the attaching base corresponding to a position of a bottom edge of the hair transplantation base.

According to an embodiment, the first hair strand body is extended from a front surface of the hair transplantation base and is draping over the hair transplantation base in a curved manner and is layered on top of the second hair strand body.

According to an embodiment, the hair weft further comprises an attaching unit which is mounted to the second weft unit for detachably mounting the hair weft to a hair of a user.

According to an embodiment, the second hair weft unit is provided between the attaching unit and the first hair weft unit, wherein the second hair strand has a higher density than the first hair strand to create a layering effect when the hair weft is worn on the user.

According to an embodiment, the attaching unit comprises a clipping member which is mounted to the attaching base of the second hair weft unit.

According to an embodiment, the attaching unit comprises a double-sided binding tape which is attached to the attaching base.

According to another aspect, the present invention provides a preparation method of a hair weft, comprising the following steps:

prepare a first hair weft unit comprising a first hair strand and a hair transplantation base, wherein the first hair strand is affixed on the hair transplantation base; and affix an attaching base of a second hair weft unit to the hair transplantation base, wherein the second hair weft unit comprises a second hair strand fixed to the attaching base, wherein the first hair strand and the second hair strand are provided at two opposite sides of the hair transplantation base to increase a hair volume of the hair weft.

According to an embodiment, the step (a) comprises a step of guiding a first root portion of the first hair strand to penetrate through the hair transplantation base and then affixing the first root portion of the first hair strand to the hair transplantation base.

According to an embodiment, the step (b) comprises a step of applying a glue material to a second root portion of the second hair strand to form the attaching base, wherein the second root portion of the second hair strand is embedded into the attaching base.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

The present specification provides steps for operating the method as described in the embodiments or flowcharts, but more or fewer steps may be included based on routine or unoriginal labor. When executed in a real-world system or server product, the methods may be executed sequentially or in parallel (e.g., a parallel processor or multi-threaded processing environment) as shown in the embodiments or the accompanying drawings.

Figure 1:
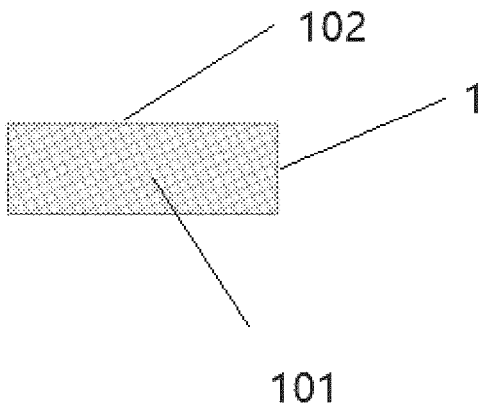
FIG. 1 is a structural schematic view of a hair transplantation base of a hair weft according to some embodiments of the present disclosure.
Figure 2:
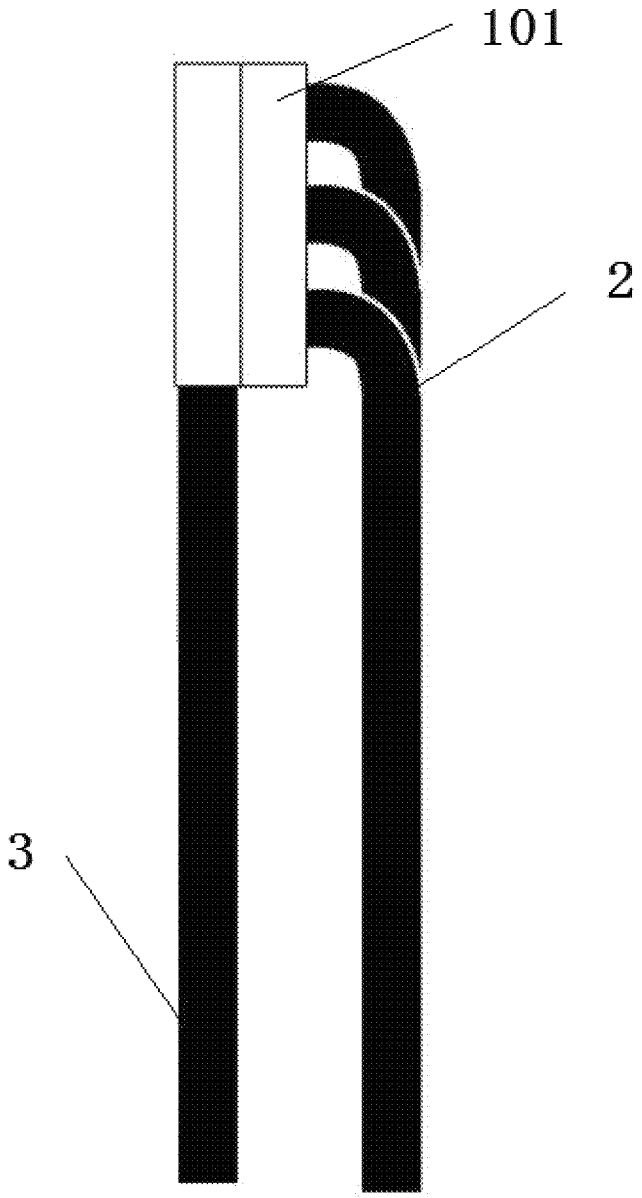
FIG. 2 is a structural schematic view of a first hair weft and a second hair weft of a hair weft after being affixed according to some embodiments of the present disclosure.

FIG. 1 is a structural schematic view of a hair transplantation base of a hair weft according to some embodiments of the present disclosure, and FIG. 2 is a structural schematic view of a first hair weft and a second hair weft of a hair weft after being affixed according to some embodiments of the present disclosure. The hair weft refers to skin weft, which can be directly braided onto the head. The embodiments of the present disclosure are intended to solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation. Referring to FIGS. 1 and 2, the structure of the hair weft includes:

a first hair weft, including a hair transplantation base 1 and a first hair strand 2;

where the hair transplantation base 1 includes a mesh base 101 and a spacer 102 disposed above the mesh base 101; the spacer 102 is configured to clamp the first hair strand 2 after the first hair strand 2 passes through the mesh base 101 and the spacer 102; the mesh base 101 is configured to affix the first hair strand 2 to a side of the mesh base 101 after the spacer 102 and the mesh base 101 are separated;

a second hair weft, including a second hair strand 3; where a top of the second hair strand 3 is fixed through quilting line and glue;

where the second hair weft is cut and affixed flush to a bottom of the first hair weft to obtain the hair weft.

The present disclosure can solve the problem, that existing hair wefts have folded hair and the folded-back short hair will be in contact with the scalp when the wearer activities, resulting in a tingling sensation, by affixing the second hair weft at the bottom of the first hair weft in a flush-fit manner. Moreover, by fixing the first hair strand 2 to one side of the mesh base 101, the mesh base has no obvious weft edge, which has a smaller thickness and is comfortable to wear. The second hair weft made by the second hair strand 3 is attached to the bottom of the first hair weft to make the finished hair weft, which has the effect of being invisible, such that the hair weft is not obvious after being worn. Because the first hair weft has a low density and volume of hair transplantation and cannot satisfy our demand for a large volume of hair, the second hair weft with a relatively large volume of hair is additionally made, and the first and second hair wefts are affixed together by means of an adhesive. To make the hair weft, the first and second hair wefts are placed vertically, and then the roots of the two hair wefts are affixed together by means of the adhesive.

In some embodiments, the material of the mesh base 101 is a non-stretchy, densely perforated, ultra-thin mesh silk yarn.

In the embodiments, the silk yarn may be Korean silk. The silk yarn is selected from the short fibers of silk by spinning and regeneration. Goods made from silk yarn or yarn woven in a plain arrangement are called silk. The texture of silk is tight and frivolous, with fine and clean surface, lubricating and flat, glossy and soft, to be used as clothing material and decorative items. Korean silk is one of the series of silk fabrics produced by combining the characteristics of Korean silk products with Chinese weaving technology. The mesh base 101 made of Korean silk has no visible weft edges, which is less thick and is comfortable to wear.

In some embodiments, the material of the spacer 102 is PVC artificial leather.

The material of the spacer 102 in the embodiments is PVC artificial leather with a thickness of 0.4 mm. A curved hook carried at a top of a needle of a transplantation machine can pierce the spacer 102 and the mesh base 101 in turn when it moves up and down, and the curved hook at the top of the needle hooks the first hair strand 2 and brings the first hair strand 2 out of the pierced hole, and the spacer 102 shrinks after the needle has been withdrawn from the hole to clamp the first hair strand 2. The spacer 102 made of PVC artificial leather has better shrinkage and is cheap and easy to obtain.

Figure 3:
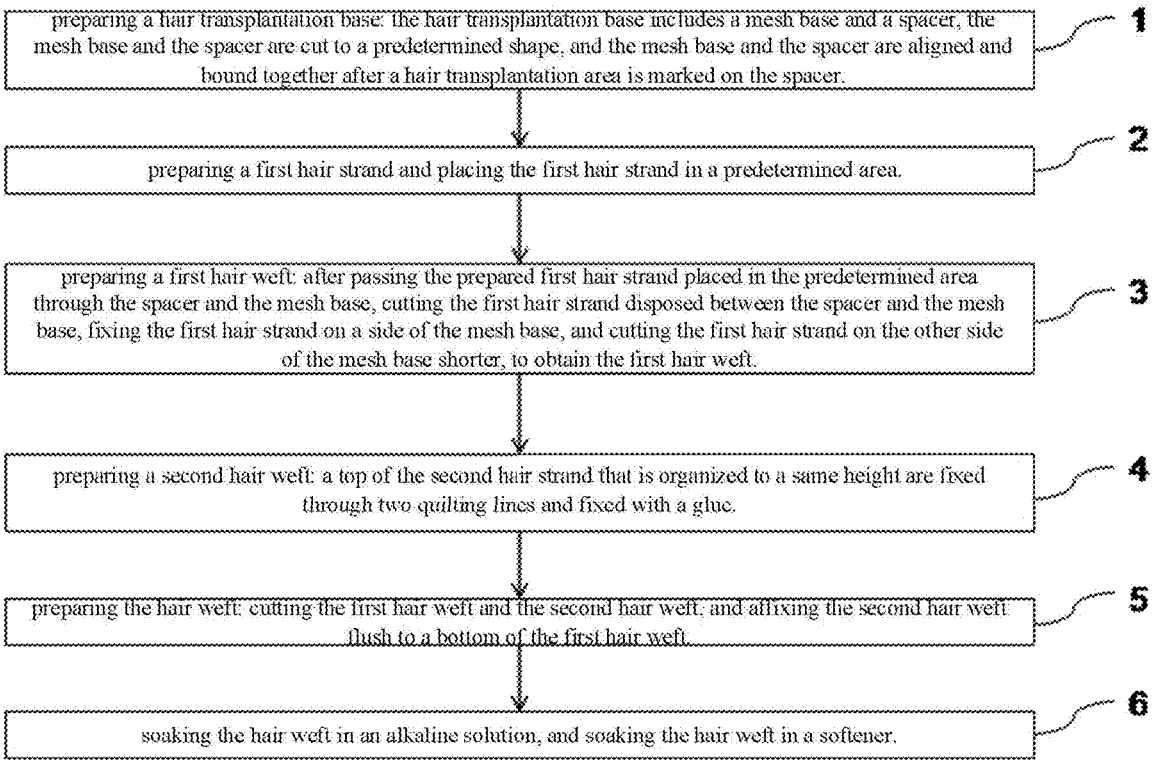
FIG. 3 is a flowchart of a preparation process of a hair weft according to some embodiments of the present disclosure.
Figure 4:
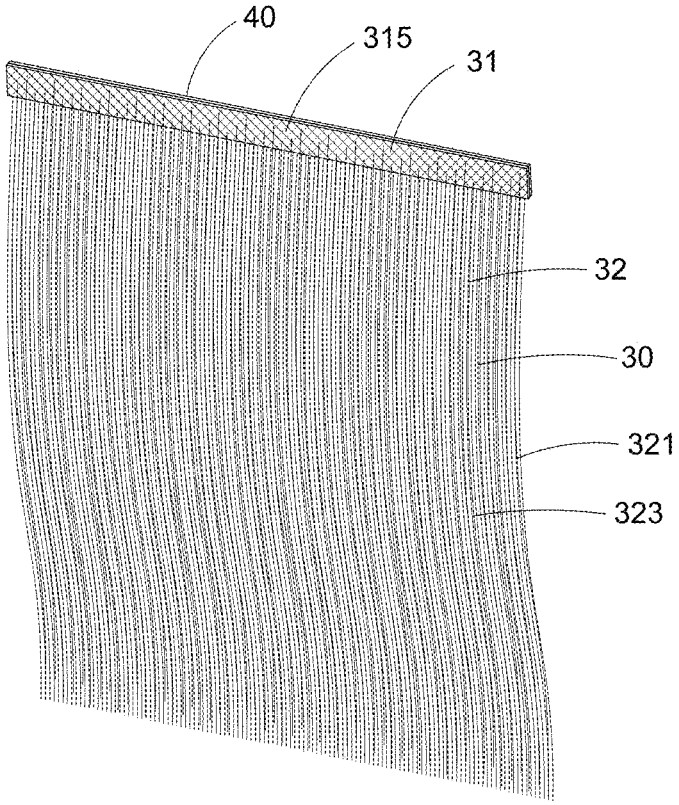
FIG. 4 is a perspective view of a hair weft according to a preferred embodiment of the present invention.
Figure 5A:
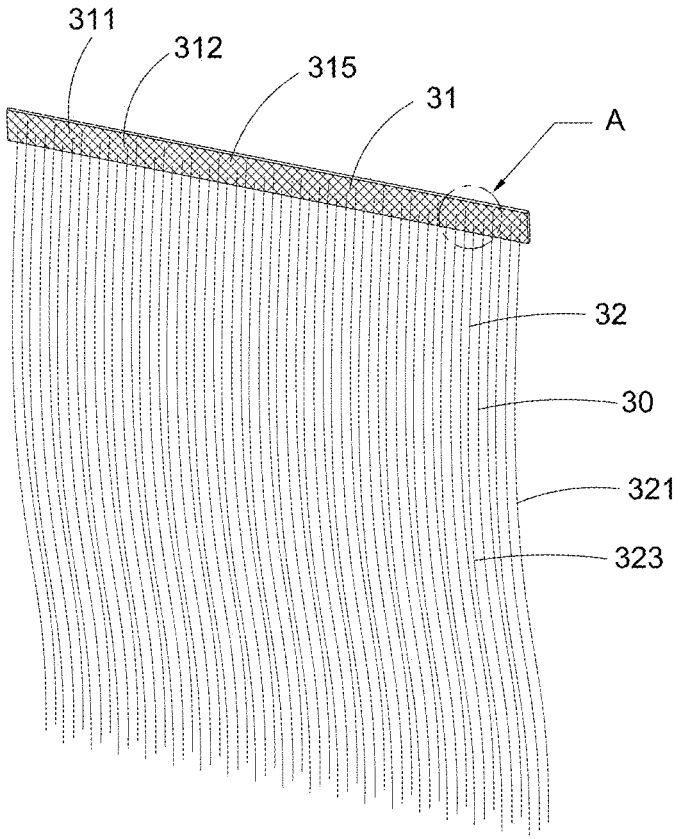
FIG. 5A is a perspective view illustrating a front side of a first hair weft unit of the hair weft according to the above preferred embodiment of the present invention.
Figure 5B:
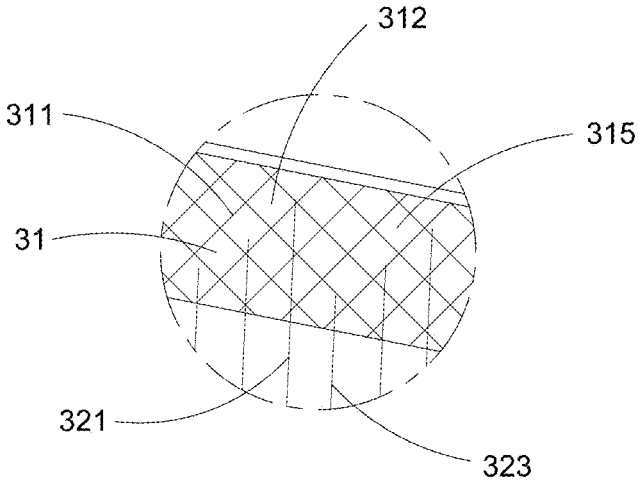
FIG. 5B is an partial enlarged view of area A in FIG. 5A.
Figure 6A:
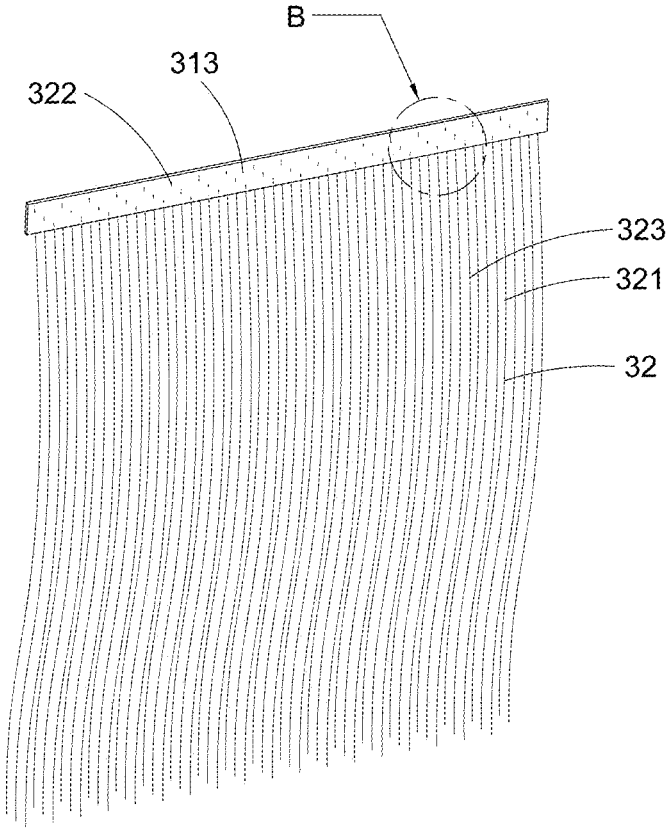
FIG. 6A is a perspective view illustrating a rear side of the first hair weft unit of the hair weft according to the above preferred embodiment of the present invention.
Figure 6B:
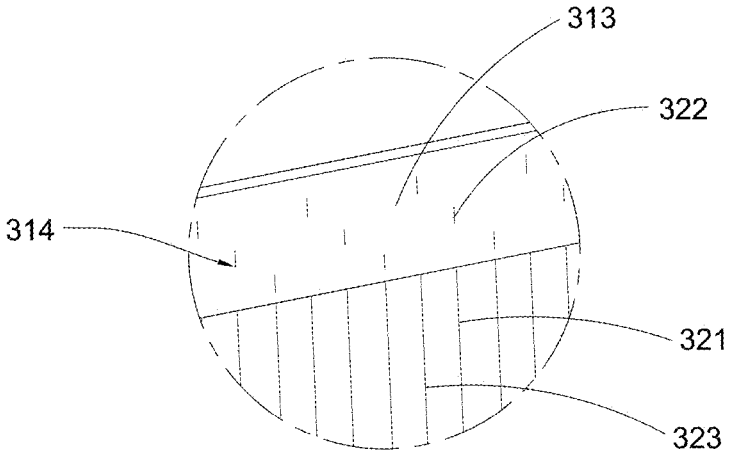
FIG. 6B is an partial enlarged view of area B in FIG. 5A.

FIG. 3 is a flowchart of a preparation process of a hair weft according to some embodiments of the present disclosure. Referring to FIG. 3, the embodiments of the present disclosure further provide a preparation process of a hair weft, including:

Step 1, preparing a hair transplantation base: the hair transplantation base includes a mesh base and a spacer, the mesh base and the spacer are cut to a predetermined shape, and the mesh base and the spacer are aligned and bound together after a hair transplantation area is marked on the spacer.

Specifically, the implementation steps of preparing the hair transplantation base include:

Step 101, cutting the mesh base and spacer to a desired shape and length.

Step 102, marking the desired hair transplantation area on the spacer with a marker.

Step 103, overlapping the mesh base and spacer, and binding and fixing the mesh base and the spacer with a stapler.

Step 2, preparing a first hair strand and placing the first hair strand in a predetermined area.

Specifically, the implementation steps of preparing a first hair strand and placing the first hair strand in the predetermined area include:

Step 201, organizing the first hair strand to a uniform height.

In step 201, a top of the first hair strand is tapped flush with a clapper board, and hair that is too short is lifted by hand to keep the overall height of the first hair strand consistent.

Step 202: fixing a middle part of the first hair strand.

In step 202, the middle part of the first hair strand is placed in two hair-beating splints with curved pins for fixing.

Step 203: placing the first hair strand in a transplantation area of a transplantation machine.

In step 203, the first hair strand is placed flat on top of the transplantation area of the transplantation machine.

Step 204: placing the mesh base and the spacer in turn above the transplantation area.

In step 204, the fabricated hair transplantation base is placed on top of the first hair strand, with the mesh base on the bottom and the spacer on the top.

Step 3, preparing a first hair weft: after passing the prepared first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft.

Specifically, the implementation steps of step 3 include:

Step 301, utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area.

In step 301, a top of a needle of the transplantation machine is arranged with a curved hook, and the curved hook pierces the spacer 102 and the mesh base 101 in turn when the needle moves up and down; upon reaching the first hair strand, the curved hook on the top of the needle hooks some of the first hair strand, and brings the some of the first hair strand out of the pierced hole, and the spacer shrinks after the machine needle is withdrawn from the hole, to clamp the some of the first hair strand. Step 301 is repeated until the first hair strand is completely transplanted in the hair transplantation area.

Step 302, cutting the first hair strand located between the spacer and the mesh base, affixing the first hair strand to the mesh base through an adhesive, and drying.

In step 302, the hair transplantation base after the hair transplantation is completed is removed from the first hair strand, and the hair strand between the mesh base and the spacer is cut through scissors to separate the mesh base from the spacer. An adhesive is applied to the first hair strand and dried in an oven. The first hair strand on the back of the mesh base is pressed down and ironed it flat through an iron such that the first hair strand is parallel to the mesh base. The adhesive is applied again to the first hair strand on the back of the mesh base and dried in the oven.

Step 303: cutting the first hair strand on the side of the mesh base away from the spacer to 0.1 to 2 cm, to obtain the first hair weft.

In step 303, the first hair strand on the back of the mesh base is trimmed to 0.1 to 2 cm through electric push shears to obtain the first hair weft.

Step 4: preparing a second hair weft: a top of the second hair strand that is organized to a same height are fixed through two quilting lines and fixed with a glue.

Specifically, the implementation steps of step 4 include: Step 401, tapping the top of the second hair strand flush with a clapper board, and hair that is too short is lifted by hand to keep the overall height of the second hair strand consistent.

Step 402, forming the two quilting lines on the top of the second hair strand through a double-needle sewing machine, to obtain a fixed preparatory hair weft.

Step 403, applying a masking tape 1.2 to 1.5 inches from a top of the preparatory hair weft to prevent the glue from penetrating into the second hair strand at a bottom during a subsequent brushing step, thereby achieving a shaping effect.

Step 404, mixing polyurethane glue, adhesive, and thinner in proportion to obtain a special glue for making the weft edge.

Step 405, applying the glue at a position above the masking tape, utilizing a scraper to repeatedly scrape the glue such that the glue contacts the second hair strand uniformly for fixing, and placing the second hair weft in an oven for drying.

Step 406, repeating step 405 three times to obtain the second hair weft.

Step 5, preparing the hair weft: cutting the first hair weft and the second hair weft, and affixing the second hair weft flush to a bottom of the first hair weft.

Specifically, the implementation steps of step 5 include:

Step 501, cutting the first hair weft and the second hair weft to production specifications.

Step 502, affixing the second hair weft flush to the bottom of the first hair weft to obtain the hair weft.

In step 502, the first hair weft and the second hair weft are placed vertically, and then the roots of the two hair wefts are affixed together by an adhesive.

Step 6, cleaning treatment: soaking the hair weft in an alkaline solution, and soaking the hair weft in a softener.

Specifically, the implementation steps of step 6 include:

Step 601, putting 100 g of the hair weft into 1 kg of 40° C. water, adding 2 g to 3 g of sodium hypochlorite solution, and soaking for 5 minutes.

Step 602: cleaning the hair weft for three times using 40° C. water.

Step 603: after the cleaning, putting the hair weft into 1 kg of 50° C. water, adding 30 g of softener, and soaking for 10 minutes.

Step 604: after the cleaning, putting the hair weft into 1 kg of 50° C. water, adding 40 g of softener, and soaking for 10 minutes.

The purpose of step 601 to step 604 is to make the product softer and smoother and eliminate static electricity.

After step 6, step 7 of drying treatment and packaging treatment is further implemented for easy storage.

Specifically, the implementation steps of step 7 include:

Step 701, after the soaking, putting the hair weft into a centrifuge for dewatering and shaking, combing the hair weft through a dense-toothed comb, scraping off floating hairs on the hair weft, putting the hair weft into the water to be slightly wetted, unfolding and flatly laying the hair weft onto an iron plate, scraping off excess water through a brush, and putting the hair weft into a drying room at 50° C. for drying.

Step 702, finishing and packaging: after drying, ironing, combing, and folding into wefts, bundling and packaging the hair weft.

The appearance of the hair weft prepared by this process is similar to the wearer's own hair, and there is no weft edge in the conventional sense of the traditional hair weft, which solves the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

It is to be noted that the hair weft product made by the present disclosure can be worn by sewing/pasting clips to make a clip hair product, or it can be worn by pasting a double-sided adhesive on the second hair weft and cutting.

Referring to FIGS. 4 to 16D of the drawings, a hair weft according a preferred embodiment of the present invention is illustrated, wherein the hair weft comprises a first hair weft unit 30 and a second hair weft unit 40 which is attached to the first hair weft unit 30 to increase a total hair volume of the hair weft.

More specifically, as shown in FIGS. 5A to 6B, the first hair weft unit 30 comprises a hair transplantation base 31 and a first hair strand 32 which is transplanted on the hair transplantation base 31. The first hair strand 32 comprises a plurality of first hair elements 321 each is fixed to the hair transplantation base 31. The material of the first hair elements 321 can be but not limited to real human hair, synthetic fiber, blended materials and animal hair. The first hair elements 321 made from real human hair can offer the most natural look and feel, and can be styled, dyed, and treated like natural hair. Artificial fibers, such as heat-resistant or low-temperature fibers, can be used for preparing the first hair elements 321 as then may not look as natural as human hair. The blended materials combine human hair with synthetic fibers to provide a balance between natural appearance and affordability. This mix aims to offer both the realistic look of human hair and the durability of synthetic fibers. The first hair element 321 also may be made from hair of animals like horses or yak, so as to offer a natural texture.

The hair transplantation base 31 comprises a silk mesh 311 and a glue layer 312 applied to the silk mesh 311, the glue material of the glue layer 312 is filled into the mesh holes of the silk mesh 311, so that the hair transplantation base 31 is an integral rigid and smooth layer which is suitable for the hair transplantation process.

The material of the silk mesh 311 can be natural silk, synthetic silk, mesh or netting. The natural silk is lightweight and provides a very natural appearance, making the hair look as if it's growing directly from the scalp. Synthetic silk can be used to reduce costs or increase durability. Nylon mesh is one of the most common materials used for netting. It's inexpensive and durable, lightweight, and breathable. Polyester mesh is also commonly used. It offers good durability and elasticity while maintaining high breathability. Alternatively, mesh caps incorporate a small amount of elastic fibers to increase elasticity and comfort, making the wig fit more snugly to the head.

In this embodiment, the silk mesh 311 can be made of Korean Silk which is a high-quality silk base material often made from synthetic silk or specially designed fibers that mimic the texture and appearance of natural silk. Korean silk is known for its fine, soft texture and natural look, providing a scalp-like appearance, making the hair look as if it is growing from the scalp. It also offers good breathability and is commonly used in high-end wigs.

The glue layer 312 may comprise one or more of acrylic resin, epoxy resin, polyurethane, plasticizers such as phthalates, fillers such as calcium carbonate, and solvents such as ethyl acetate, ethanol, acetone.

The first hair strand 32 comprises a first root portion 322 and a first hair strand body 323, the first root portion 322 of the first hair stand 32 is penetrated through the hair transplantation base 31 and is then fixed to a rear surface of the hair transplantation base 31 by a fixing glue, the rear surface of the hair transplantation base 31 is a binding surface 313 for adhering the first root portion 322 of the first hair strand 32. The first hair strand body 323 is extended at a front side of the hair transplantation base 31. Both of the first root portion 322 and the first hair strand body 323 are formed by the plurality of the first hair elements 321 which are aligned with each other in a strand.

The hair transplantation base 31 is correspondingly formed with a plurality of transplantation holes 314 when the first root portion 322 of the first hair stand 32 is passing through the glue layer 312 of the hair transplantation base 31. The first root portion 322 and the first strand body 323 are extended at two opposite sides of the hair transplantation base 31.

Figure 10:
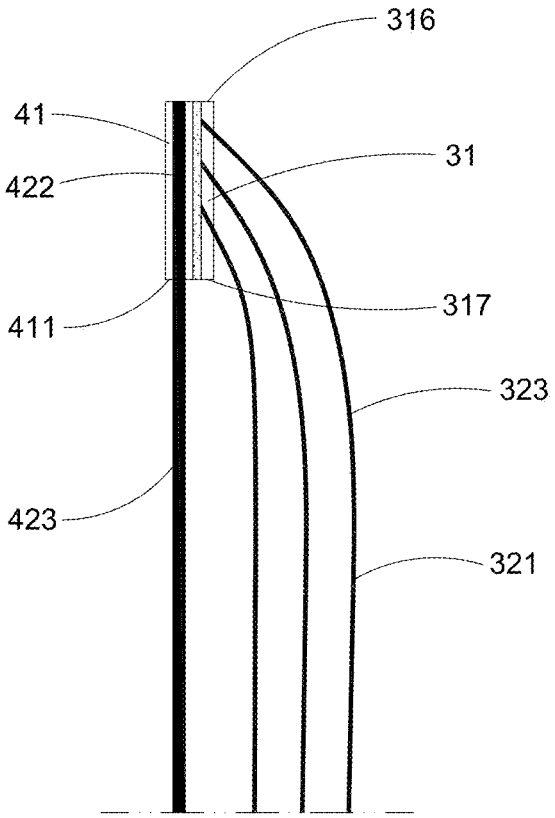
FIG. 10 is a sectional view illustrating the hair weft according to the above preferred embodiment of the present invention.

Atop end of the first hair stand body 323 is planted on a front surface 315 of the hair transplantation base 31, and a top row of first hair elements 321 of the plurality of first hair elements 321 can be extended from a position on the front surface 315 adjacent to a top edge 316 of the hair transplantation base 31, as shown in FIG. 10, so that more first hair elements 321 are planted on the hair transplantation base 31.

Figure 7A:
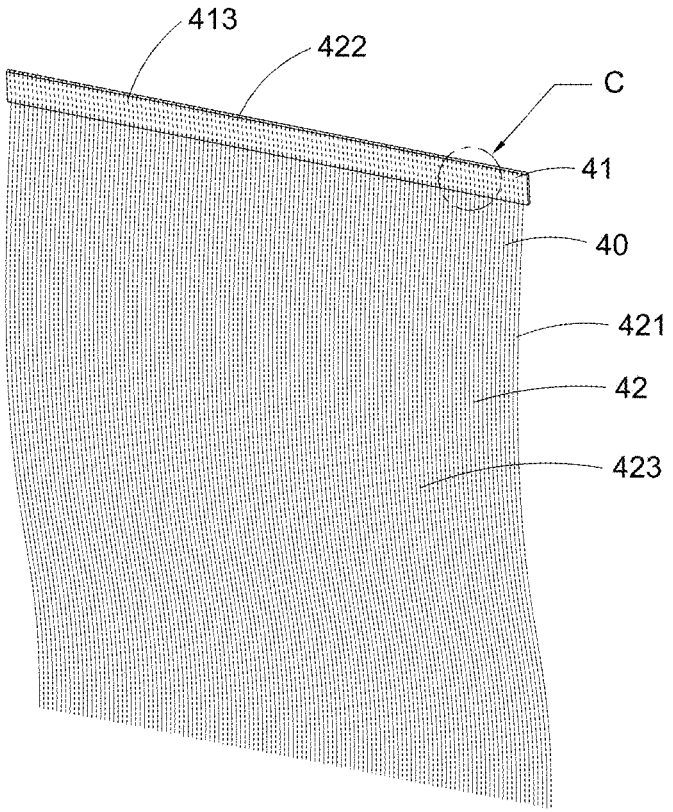
FIG. 7A is a perspective view illustrating a rear side of the first hair weft unit of the hair weft according to the above preferred embodiment of the present invention.
Figure 7B:
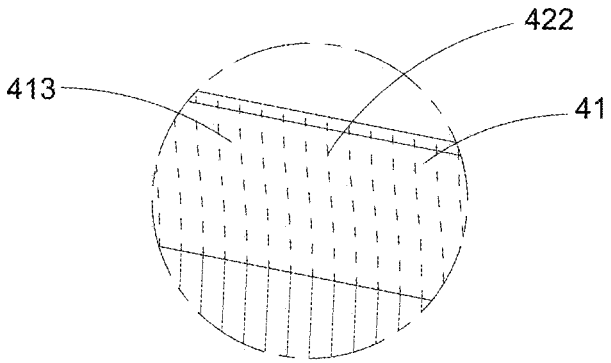
FIG. 7B is an partial enlarged view of area C in FIG. 5A.

Referring to FIGS. 7A and 7B, the second hair weft unit 40 comprises an attaching base 41 and a second hair strand 42 fixed to the attaching base 41. The attaching base 41 is adhered to the rear binding surface 313 of the hair transplantation base 31 by a binding glue, so as to fix and mount the second hair weft unit 40 to the first hair weft unit 30.

According to this embodiment, the attaching base 41 can be formed by a glue material, such as a mixture of polyurethane glue, adhesive, and thinner or diluent. The adhesive can be but not limited to isocyanates and polyester polyols. The thinner can be but not limited to ethyl acetate, xylene, acetone, and methyl ethyl ketone. Preferably, a weight content of polyurethane glue is ranged from 40%-60%, a weight content of adhesive is ranged from 10%-30%, and a weight content of thinner is ranged from 20%-40%.

The binding glue for attaching the attaching base 41 to the hair transplantation base 31 may contain one or more of epoxy resin, polyurethane, acrylic resin adhesive, phenolic resin adhesive, polyester resin adhesive, and neoprene adhesive.

Figure 16A:
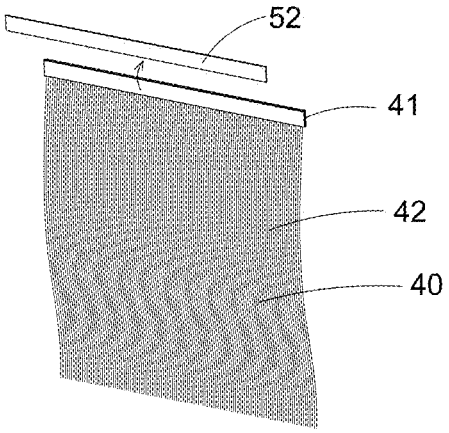
FIGS. 16A, 16B, 16C and 16D are schematic views illustrating the preparing of the hair weft by attaching the first hair weft unit to the second hair weft unit according to another alternative mode of the above preferred embodiment of the present invention.
Figure 16B:
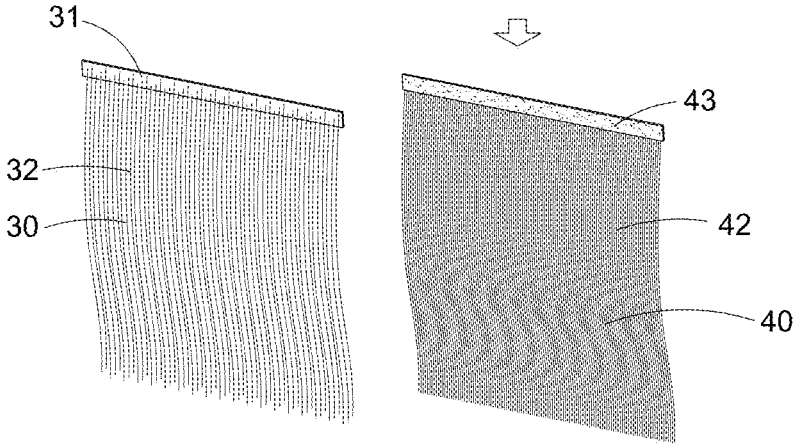
Figure 16C:
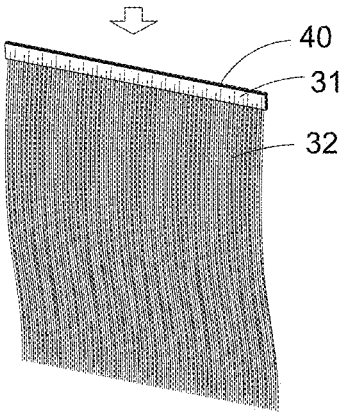
Figure 16D:
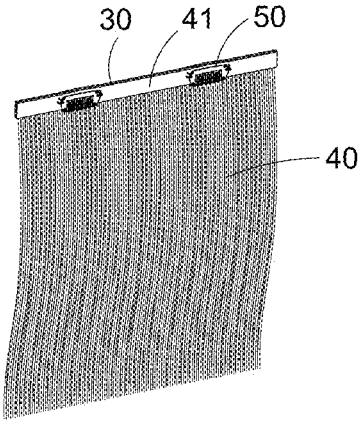

Alternatively, as another alternative mode, with reference to FIG. 16B, the attaching base 41 may be attached to the hair transplantation base 31 by a double-sided tape 43. In other words, the attaching base 41 and the hair transplantation base 31 can be adhered to two opposite sides of the double-sided tape 43.

The second hair strand 42 comprises a plurality of second hair elements 421, and the material of the second hair elements 421 can be but not limited to real human hair, synthetic fiber, blended materials and animal hair. The second hair strand 42 also comprise a second root portion 422 and a second hair strand body 423 integrally extended from the second root portion 422, the plurality of second hair elements 421 are arranged in rows to form the second root portion 422 and the second hair strand body 423.

In this embodiment, the second root portion 422 of the second hair strand 42 is embedded in the attaching base 41. During the preparing process of the second hair weft unit 40, run two or more rows of stitching 424 along the second root portion 422 of the second hair strand 42 using a sewing machine to obtain a secured preparatory hair weft, and then the glue material of the mixture of polyurethane glue, adhesive, and thinner is applied to the second root portion 422 of the second hair strand 42, and dried to form the attaching base 41 which is embedded with the second root portion 422 of the plurality of second hair elements 421. In this embodiment, the attaching base 41 is shaped and sized to couple with the hair transplantation base 31, so as to form an integral base for supporting the first hair strand 32 and the second hair strand 42. As shown in FIG. 10 of the drawings, the first hair strand body 323 of the first hair strand 32 and the second hair strand body 423 of the second hair strand 42 are provided at two opposite sides of the hair transplantation base 31, so that the two hair weft units are combined to result in a final product that meets a high volume requirement. Gluing the hair transplantation base 31 between the two hair strands ensures a strong bond and seamless integration of the two hair weft units, creating a cohesive and natural-looking final product.

More specifically, the first hair strand body 323 of the first hair strand 32 is extended from the front surface 315 of the hair transplantation base 31, and a top end of the second hair strand body 423 of the second hair strand 42 is extended from a bottom edge 411 of the attaching base 411 and is preferred to be extending from a position corresponding to a bottom edge 317 of the hair transplantation base 31.

According to this embodiment, a top row of the first hair elements 321 of the first hair strand body 323 is extended from the top edge 316 of the hair transplantation base 31 and is naturally draping over the hair transplantation base 31 in a curved manner, the second hair strand body 423 is straightly extended from the bottom edge of the hair transplantation base 31, the starting points of their extensions are different, with the more curled first hair strand body 323 overlaying the second hair strand 42, a sense of depth and layering is created, so as to enhance the overall realism of the transplanted hair and improve texture, making the transplanted hair look more voluminous and lifelike. In other words, the two hair strand bodies provide varying textures and layers, this visual depth and texture is liking the natural growth patterns of hair, making the hairpiece look more authentic and appealing.

In addition, the first hair strand 32 has a lower density while the second hair strand 42 can be configured to have a higher density. In other words, in a same designated area corresponding to an area in the hair transplantation base 31, the number of the first hair elements 321 is smaller than the number of the second hair elements 421, so that the varying densities of the two hair strands contribute to a more pronounced layered effect, further mimicking natural hair growth.

Figure 11:
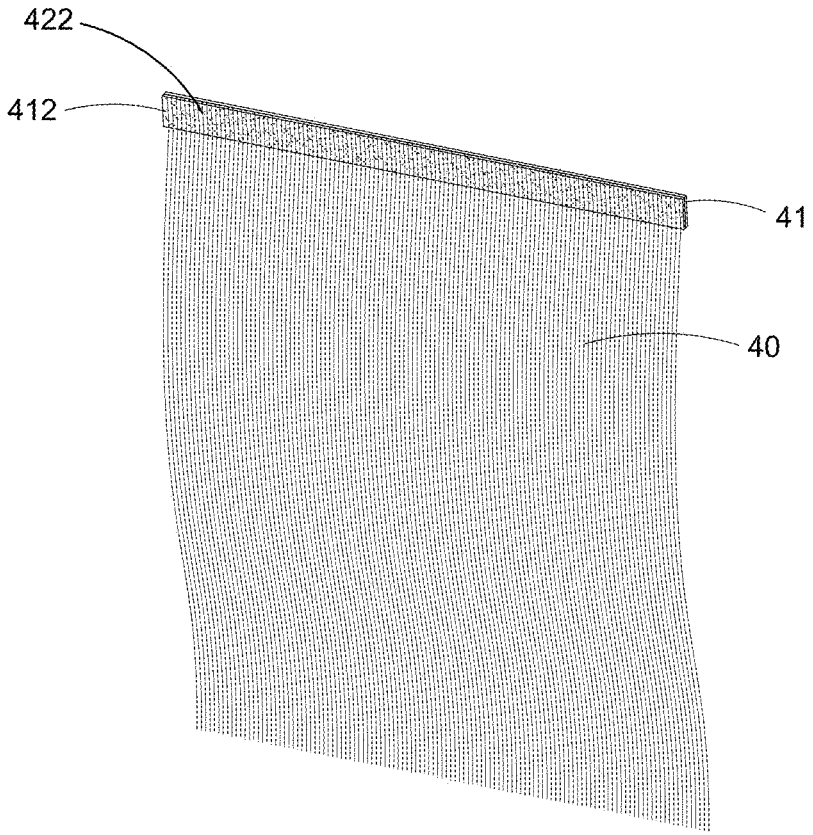
FIG. 11 is a perspective view illustrating a second hair weft unit of the hair weft according to an alternative mode of the above preferred embodiment of the present invention.
Figure 12:
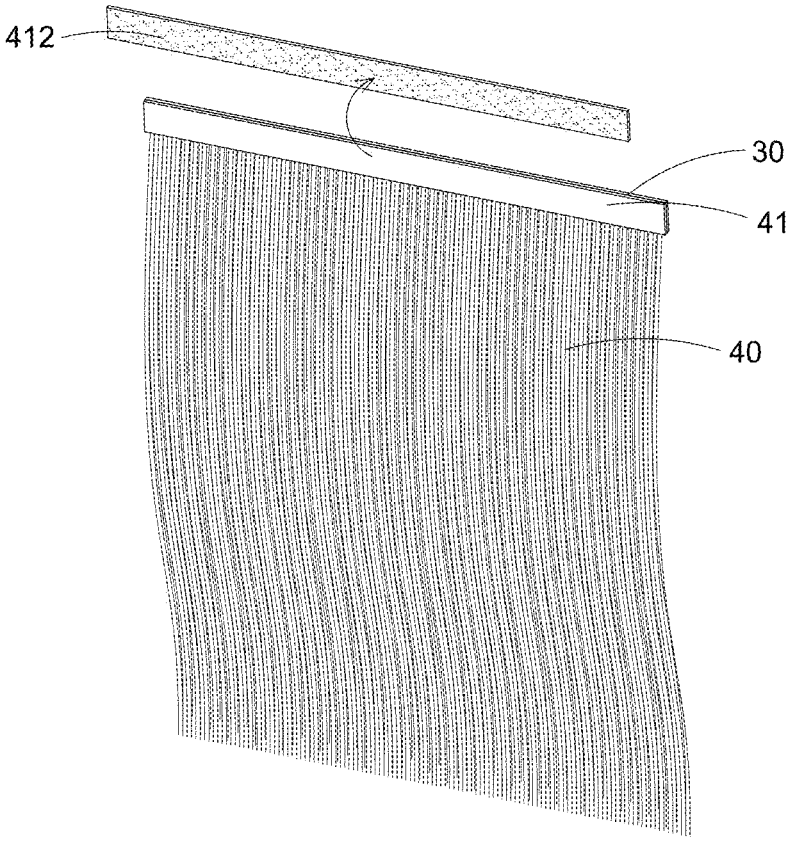
FIG. 12 is a schematic view illustrating the hair weft according to an alternative mode of the above preferred embodiment of the present invention.
Figure 13A:
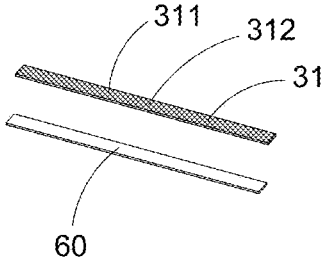
FIGS. 13A, 13B, 13C and 13D are schematic views illustrating the preparing of the first hair weft unit of the hair weft according to the above preferred embodiment of the present invention.
Figure 13B:
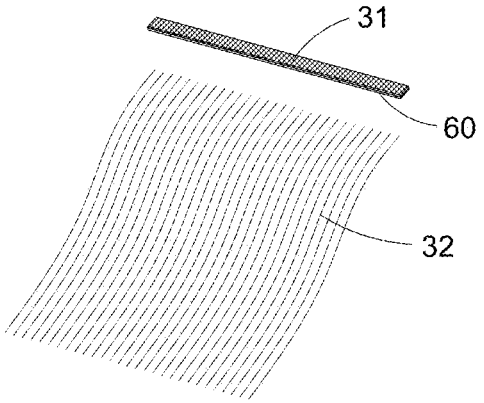
Figure 13D:
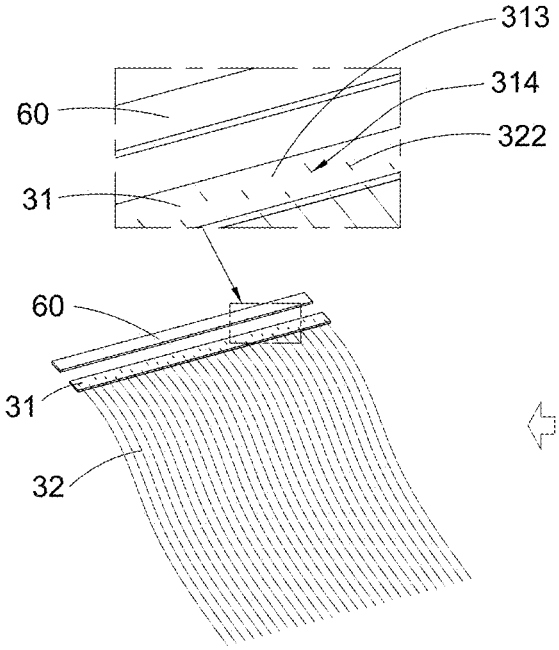
Figure 13C:
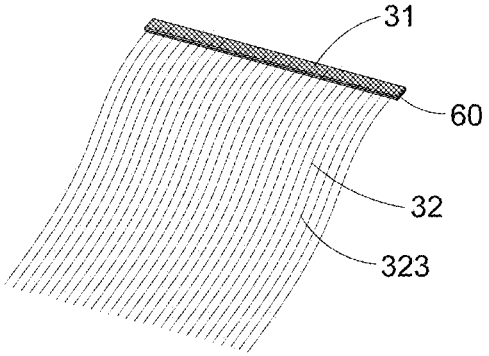
Figure 14A:
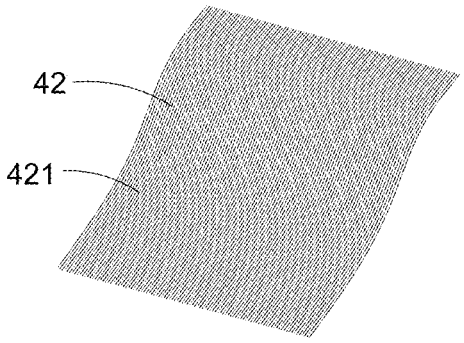
FIGS. 14A, 14B, 14C, 14D, 14E and 14F are schematic views illustrating the preparing of the second hair weft unit of the hair weft according to the above preferred embodiment of the present invention.
Figure 14B:
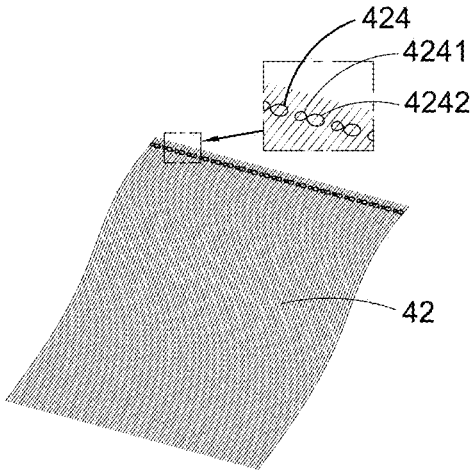
Figure 14D:
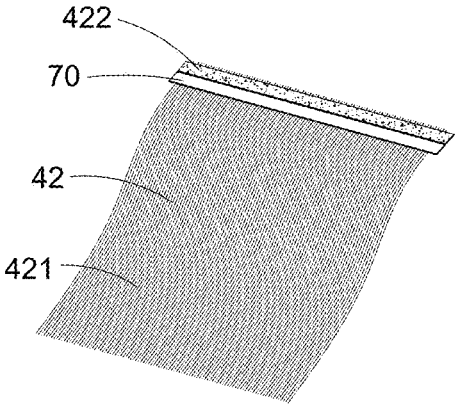
Figure 14C:
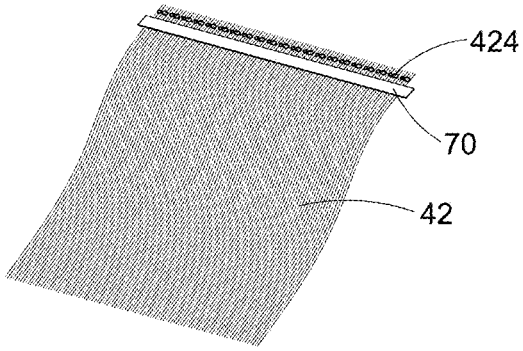
Figure 14E:
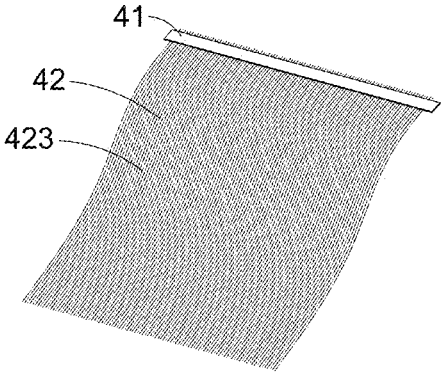
Figure 14F:
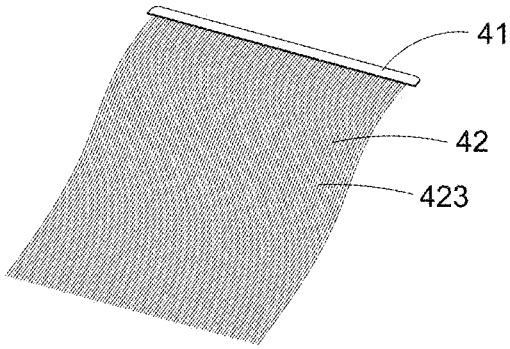
Figure 15A:
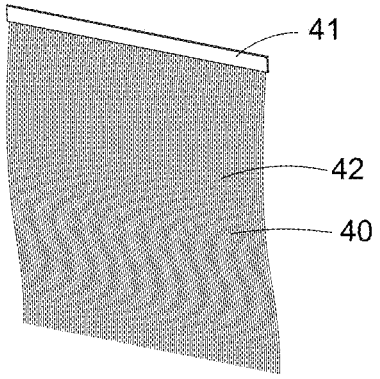
FIGS. 15A, 15B, 15C and 15D are schematic views illustrating the preparing of the hair weft by attaching the first hair weft unit to the second hair weft unit according to the above preferred embodiment of the present invention.
Figure 15B:
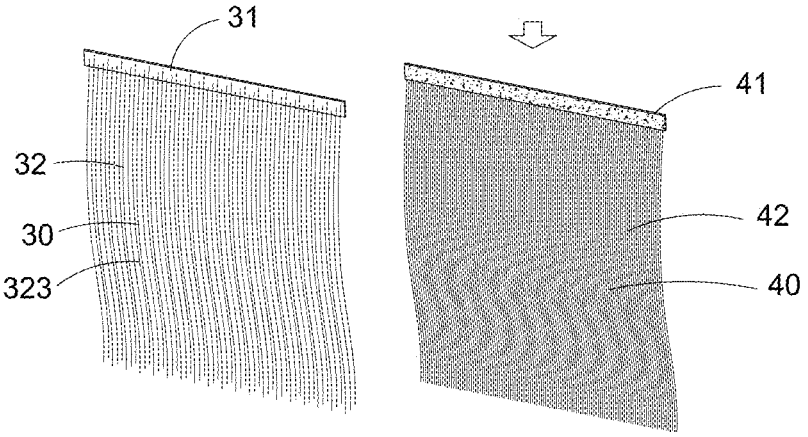
Figure 15C:
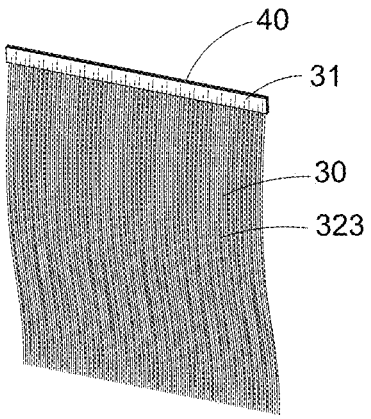
Figure 15D:
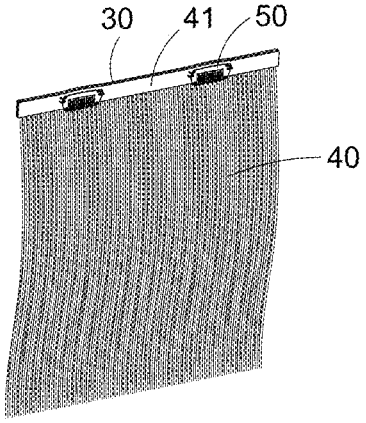

Referring to FIGS. 11 and 12 of the drawings, according to an alternative mode, the second hair weft unit 40 comprises an attaching base 41 and a second hair strand 42 fixed to the attaching base 41. The attaching base 41 in this embodiment is an adhering tape, and a second root portion 422 of the second hair strand 42 is adhered to an adhering surface 412 of the adhering tape, and the adhering tape is adhered to the rear binding surface 313 of the hair transplantation base 31 by a binding glue, so as to fix and mount the second hair weft unit 40 to the first hair weft unit 30.

The adhering tape can be a double-sided tape, so that the other side of the adhering tape which is not attached with the second hair strand 42 can be used for being adhered to the hair of the user, so as to wear the hair weft of the present invention on the user.

Referring to FIGS. 8A to 9B of the drawings, the hair weft further comprises an attaching unit 50 which is coupled to a rear side of the attaching base 41 of the second hair weft unit 40 for coupling the hair weft to the hair of the user. Accordingly, the attaching base 41 has a front surface 413 that is adhered to the hair transplantation base 31, and a rear surface 414 for mounting the attaching unit 50.

In this embodiment, the attaching unit 50 comprises a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the hair transplantation base 31 and the attaching base 41, as well as the corresponding fixing holes 5111 for connecting the fixing base 511 to the first hair weft unit 30 and the second hair weft unit 40.

Figure 8A:
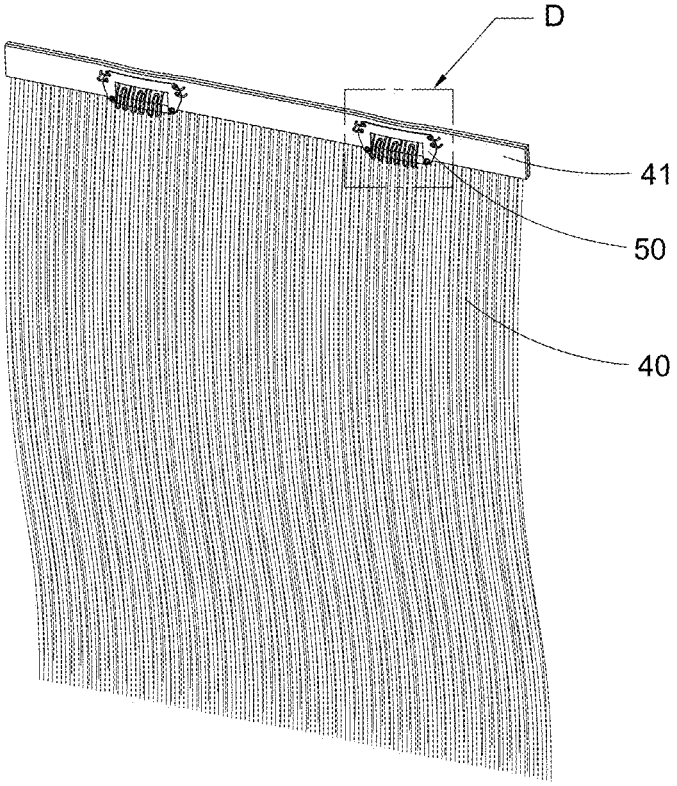
FIG. 8A is a perspective view illustrating a rear side of the hair weft according to the above preferred embodiment of the present invention, wherein a clipping element is in an open state.
Figure 8B:
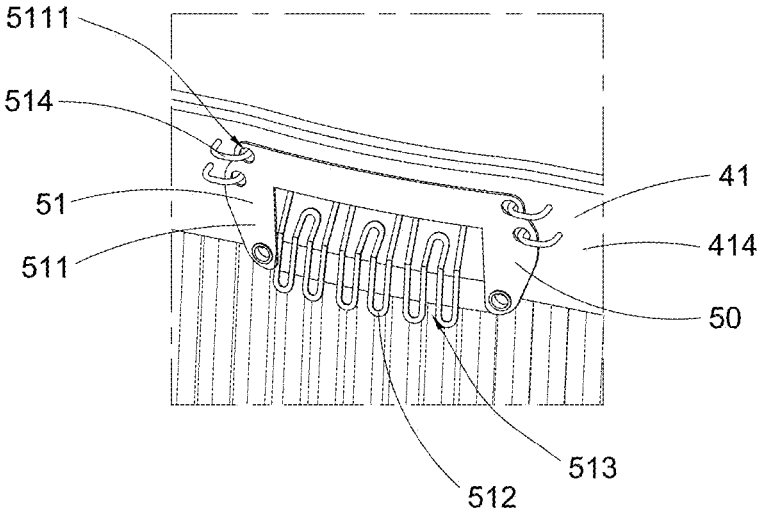
FIG. 8B is an partial enlarged view of area D in FIG. 8A.
Figure 9A:
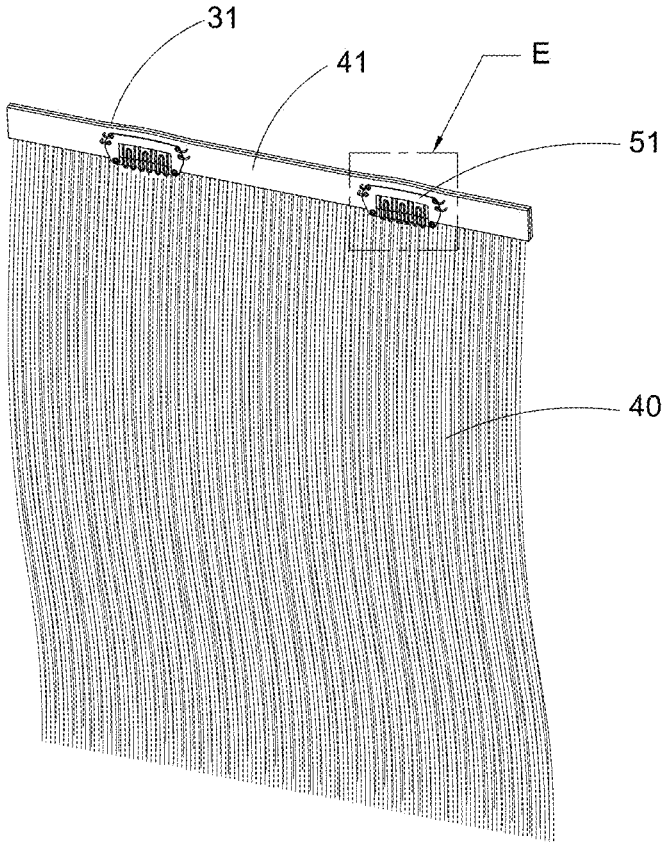
FIG. 9A is a perspective view illustrating the clipping element of the hair weft being in a closed state according to the above preferred embodiment of the present invention.
Figure 9B:
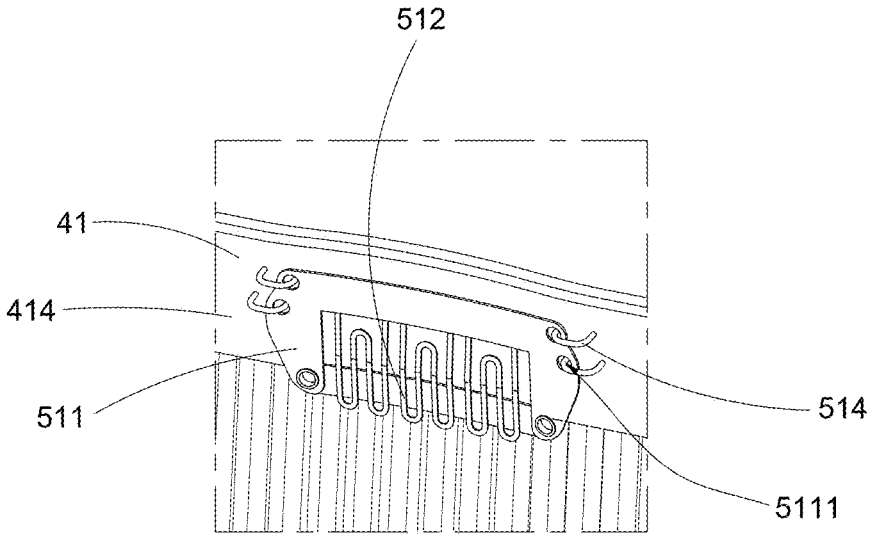
FIG. 9B is an partial enlarged view of area E in FIG. 9A.

As shown in FIGS. 8B and 9B of the drawings, the fixing base 511 has two sets of fixing holes 5111 at two end portions thereof, and the clipping element 51 comprises two connecting strings 514 mounted to each of the two sets of fixing holes 5111 respectively.

The fixing base 511 is made of a resilient material, and in a closed state, the clipping member 512 is attached to the fixing base 511. When in a use state, the two end portions of the fixing base 511 can be pressed to deform the fixing base 511, so that the clipping member 512 is spaced apart from the fixing base 511 to define the clipping groove 513.

When the hair weft of the present invention is worn on the head of the user, the attaching unit 50 is attached to the head of the user, the second weft unit 40 is provided under the first weft unit 30 and is more close to the scalp, so that by replicating the natural decrease in hair density from the scalp outwards, the hair weft of the present invention achieves a more authentic and lifelike look. The higher density of the second hair strand 42 positioned nearer the scalp creates a fuller and more secure attachment, potentially improving comfort and preventing slippage.

Referring to FIGS. 16A to 16D of the drawings, as an alternative mode, the hair weft further comprises an attaching unit 50 which is coupled to a rear side of the attaching base 41 of the second hair weft unit 40 for coupling the hair weft to the hair of the user. In this embodiment, the attaching unit 50 comprises a double-sided binding tape 52, one side of the double-sided binding tape 52 is attached to the rear surface 414 of the attaching base 41, the other side of the double-sided binding tape 52 is used for adhering the hair of the user during usage.

The person of ordinary skilled in the art should understand that in alternative modes, the hair weft may comprises two first hair weft units 30, the hair transplantation bases 31 of the two first hair weft units 30 are attached with each other, so as to form two layers of hair strands. The attaching unit 50 which may be the double-sided binding tape 52 can be attached to one of the first hair weft units 30 for mounting the hair weft to the hair of the user.

In another alternative mode, the hair weft may comprises the first hair weft unit 30 and the second hair weft unit 40, and the second hair weft unit 40 can be mounted to the front surface 315 of the first hair weft unit 30, and an upper portion of the first hair strand body 322 is sandwiched between the hair transplantation base 31 of the first hair weft unit 30 and the attaching base 41 of the second hair weft unit 40.

Referring to FIGS. 13A to 15D of the drawings, a preparing method of the hair weft according to the preferred embodiment of the present invention is illustrated, the preparing method comprises a process of preparing the first hair weft unit 30, a process of preparing the second hair weft unit 40, a process of attaching the second hair weft unit 40 to the first hair weft unit 30, a process of cleaning the hair weft unit, and a process of mounting the attaching unit 50 to the second hair weft unit 40.

The process of preparing the first hair weft unit 30 comprises a step of mounting a support piece 60 with the hair transplantation base 31, and a step of transplanting the first hair strand 32 on the hair transplantation base 31.

More specifically, referring to FIGS. 13A to 13D, the support piece 60 with a marked transplantation area is aligned with the hair transplantation base 31, the support piece 60 is shaped and sized to couple with the hair transplantation base 31 and then is fixed with the hair transplantation base 31. For example, a stapler can be used to fix the support piece 60 with the hair transplantation base 31. The hair transplantation base 31 is prepared by applying the glue layer 312 on the silk mesh 311.

When transplanting the first hair strand 32 on the hair transplantation base 31, a middle part of the material of the first hair strand 32 is fixed by two clamping plates each is provided with a curved pin, and then the material of the first hair strand 32 is placed in a transplantation area of a transplantation machine, the combination of the support piece 60 and the hair transplantation base 31 is placed on the first hair strand 32 in a manner that the hair transplantation base 31 is sandwiched between the support piece 60 and the hair transplantation base 31.

The transplantation machine is then in operation to drive needle hooks to guide the material of the first hair strand 32 to pass through the hair transplantation base 31 and the support piece 60. And then the portion of the material of the first hair strand 32 disposed between the support piece 60 and the hair transplantation base 31 is cut to leave a first root portion 322 of the first hair strand 32 on the rear binding surface 313 of the hair transplantation base 31. The support piece 60 is thus separated from the hair transplantation base 31. The length of the first root portion 322 is preferred to be ranged from 0.1 cm-2 cm. Finally, a fixing glue is applied to the first root portion 322 of the first hair strand 32 to the rear binding surface 313 of the hair transplantation base 31.

The support piece 60 can be a natural leather layer or a PVC artificial leather layer. In this embodiment, the support piece 60 is made of PVC artificial leather and has a thickness of 0.4 mm. After the needle hooks of the transplantation machine pierce the support piece 60 and the glue layer 312 of the hair transplantation base 31 in turn when the needle hooks move up and down, the material of the first hair elements 321 of the first hair strand 32 is guided to be out of the pierced transplantation holes 314, and the resilient support piece 60 shrinks after the needle has been withdrawn from the transplantation holes 314, so as to clamp and retain the first hair strand 32 in position.

Referring to FIGS. 14A to 14F, the process of preparing the second hair weft unit 40 comprises the steps of stitching a top of the second hair strand 42 to obtain a fixed preparatory hair weft unit, applying a masking tape 70 which is 1.2 inches to 1.5 inches from a top of the preparatory hair weft unit to define the second root portion 422 of the second hair strand 42, and applying a glue material on the second root portion 422 of the second hair strand 42 to form the attaching base 41 which is embedded with the second root portion 422 of the second hair strand 42.

Accordingly, the stitching 424 of the two quilting lines is formed on the second root portion 422 of the second hair strand 42 through a double-needle sewing machine. In this embodiment, the second hair weft unit 40 comprises a first stitching line 4241 and a second stitching line 4242, the two intersecting stitching lines 4241 and 4242 are arranged in an "8" pattern. The first stitching line 4241 is made of a water-soluble thread, and the second stitching line 4242 is a cotton thread. When exposed to the liquid glue material, the water-soluble thread of the first stitching line 4241 dissolves, causing the cotton thread of the second stitching line 4242 to detach. The purpose of these two stitching liens 4241 and 4242 is to keep the material of the second hair strand 42 of the second hair weft unit 40 be flat and stable when placed on a glass surface for applying the glue material, preventing it from shifting or moving around.

The masking tape 70 is arranged to define the second root portion 422 and the second hair strand body 423 of the second hair strand 42 by preventing the glue material applied on the second root portion 422 to flow towards the second hair strand body 423 of the second hair strand 42.

The glue material can be a mixture of polyurethane glue, adhesive, and thinner or diluent. The adhesive can be but not limited to isocyanates and polyester polyols. The thinner can be but not limited to ethyl acetate, xylene, acetone, and methyl ethyl ketone. The preparation of the glue material comprises a step of mixing polyurethane glue, adhesive, and thinner, wherein a weight content of polyurethane glue is ranged from 40%-60%, a weight content of adhesive is ranged from 10%-30%, and a weight content of thinner is ranged from 20%-40%.

Referring to FIGS. 15A to 15D, in the process of attaching the second hair weft unit 40 to the first hair weft unit 30, the binding glue is applied between the attaching base 41 and the hair transplantation base 31, so as to for the hair weft comprising the first hair weft unit 30 and the second hair weft unit 40. The binding glue is made of one or more of epoxy resin, polyurethane, acrylic resin adhesive, phenolic resin adhesive, polyester resin adhesive, and neoprene adhesive.

Alternatively, the attaching base 41 and the hair transplantation base 31 are respectively adhered to two opposite sides of a double-sided tape, so as to assembly the first weft unit 30 with the second weft unit 401.

In the process of cleaning the hair weft unit comprising the first weft unit 30 and the second weft unit 40, 100 g of the hair weft is added into 1 kg of 40° C. water, 2 g to 3 g of sodium hypochlorite solution is added into the water, and soak for 5 minutes; and then clean the hair weft for three times using 40° C. water; after the cleaning, the hair weft is put into 1 kg of 50° C. water, 30 g of softener is added, and soak for 10 minutes; after the previously cleaning step, the hair weft is put into 1 kg of 50° C. water, 40 g of softener is added, and soak for 10 minutes, so as to make the product softer and smoother and eliminate static electricity.

After the above cleaning step with the water, a drying treatment is further implemented for easy storage. More specifically, after the soaking, the hair weft is put into a centrifuge for dewatering and shaking, the hair weft is combined through a dense-toothed comb to scrape off floating hairs on the hair weft, the hair weft is then put into the water to be slightly wetted, unfold and flatly lay the hair weft onto an iron plate, scrape off excess water through a brush, and then the hair weft is put into a drying room at 50° C. for drying.

In the process of mounting the attaching unit 50, the attaching unit 50 which can be embodied as a clipping element 51 is attached to the rear surface 414 of the attaching base 41 of the second weft unit 40 by the connecting strings 514 which are respectively penetrating through the attaching base 41 and the hair transplantation base 31.

As an alternative mode, a double-sided binding tape 5 is used as the attaching unit 50, one side of the double-sided binding tape 52 is attached to the rear surface 414 of the attaching base 41, the other side of the double-sided binding tape 52 is used for adhering the hair of the user during usage.

It is to be noted that in this document, relational terms such as first and second are used only to distinguish one entity or operation from another, and do not necessarily require or imply the existence of any such actual relationship or order between these entities or operations. Furthermore, the terms "including", "having", or any other variant thereof, are intended to cover non-exclusive inclusion, such that a process, method, article, or apparatus including a set of elements includes not only those elements, but also other elements not expressly listed, or elements that are inherent to such process, method, article, or apparatus may be included. Without further limitation, the fact that an element is defined by the phrase "including a . . . " does not exclude the existence of another identical element in the process, method, article, or apparatus including the element.

Each of the embodiments in this specification is described in a related manner, and it is sufficient to refer to each embodiment for similarities between embodiments, and each embodiment focuses on the differences from other embodiments. In particular, for a system embodiment, since it is basically similar to the method embodiment, it is described in a simpler manner, and it is sufficient to refer to a part of the description of the method embodiment where relevant.

The above description is only some embodiments of the present disclosure, and is not intended to limit the scope of the present disclosure. Any modifications, equivalent substitutions, improvements, etc. made within the spirit and principles of the present disclosure are included in the scope of the present disclosure.

What is claimed is:

1. A hair weft, comprising:

a first hair weft unit comprising a first hair strand and a hair transplantation base having a rear binding surface and a front surface, wherein said first hair strand is fixed to said hair transplantation base, wherein said first hair strand comprising a plurality of first hair elements each having a first root portion fixing at said rear binding surface of said hair transplantation base and a first strand body extending out of said hair transplantation base at said front surface thereof; and a second weft unit comprising a second hair strand and an attaching base, wherein said second hair strand is fixed to said attaching base, wherein said attaching base is attached to said rear binding surface of said hair transplantation base so as to affix said first root portions of said first hair elements between said hair transplantation base and said attaching base, wherein said second hair strand comprises a plurality of second hair elements each having a second root portion affixing to said attaching base.

2. The hair weft, as recited in claim 1, wherein said hair transplantation base comprises a plurality of mesh holes, wherein said first root portion is penetrating through said hair transplantation base through said mesh holes and adhered to said rear binding surface of said hair transplantation base, such that said first root portions of the first hair elements are glued between the hair transplantation base and the attaching base, wherein said first hair strand body and said first root portion are provided at two opposite sides of said hair transplantation base.

3. The hair weft, as recited in claim 2, wherein said hair transplantation base comprises a silk mesh having said mesh holes formed thereon for said first root portions of said first hair elements penetrating though said silk from one side to another side, and a glue layer applied on said silk mesh to fill up said mesh holes of said silk mesh to retain said first root portions of said first hair elements on said hair transplantation base.

4. The hair weft, as recited in claim 2, wherein each of said second hair elements of said second hair strand comprises a second hair strand body integrally extended from said second root portion, wherein said second root portion of said second hair strand is fixed to said attaching base from a top edge thereof while said second hair strand body of said second hair strand is extended out of said attaching base at a bottom edge thereof.

5. The hair weft, as recited in claim 4, wherein said attaching base of said second weft unit is formed by a glue material, wherein said second root portion of said second weft unit is embedded in said attaching base, wherein said attaching base is shaped and sized corresponding to said hair transplantation base.

6. The hair weft, as recited in claim 5, wherein said glue material of said attaching base of said second weft unit comprises a mixture of polyurethane glue, adhesive, and thinner.

7. The hair weft, as recited in claim 6, wherein in said glue material of said attaching base of said second weft unit, a weight content of polyurethane glue is ranged from 40%-60%, a weight content of adhesive is ranged from 10%-30%, and a weight content of thinner is ranged from 20%-40%.

8. The hair weft, as recited in claim 4, wherein said attaching base of said second weft unit comprises an adhering surface not only adhering said second root portion thereon but also adhering to said rear binding surface of said hair transplantation base.

9. The hair weft, as recited in claim 4, wherein said first hair strand body of said first hair strand and said second hair strand body of said second hair strand are provided at two opposite sides of said hair transplantation base.

10. The hair weft, as recited in claim 9, wherein a density of said first hair strand is lower than a density of said second hair strand.

11. The hair weft, as recited in claim 9, wherein a top end of said second hair strand body of said second hair strand is extended from the bottom edge of said attaching base corresponding to a position of a bottom edge of said hair transplantation base.

12. The hair weft, as recited in claim 9, wherein said first hair strand body is extended from the front surface of said hair transplantation base and is draping over said hair transplantation base in a curved manner and is layered on top of said second hair strand body.

13. The hair weft, as recited in claim 9, further comprising an attaching unit which is mounted to a rear surface of said second weft unit for detachably mounting the hair weft to a hair of a user.

14. The hair weft, as recited in claim 13, wherein said second hair weft unit is provided between said attaching unit and said first hair weft unit, wherein said second hair strand has a higher density than said first hair strand to create a layering effect when the hair weft is worn on the user.

15. The hair weft, as recited in claim 13, wherein said attaching unit comprises a clipping member which is mounted to said rear surface of said attaching base of said second hair weft unit.

16. The hair weft, as recited in claim 13, wherein said attaching unit comprises a double-sided binding tape which is attached to said rear surface of said attaching base, such that said attaching base is sandwiched between said hair transplantation base and said double-sided binding tape.

* * * * *